United States Patent [19]

Martens, III et al.

[11] Patent Number: 4,849,606

[45] Date of Patent: Jul. 18, 1989

[54] TAMPER-RESISTANT CONTAINER UTILIZING A FLEXIBLE SEAL

[75] Inventors: Edward J. Martens, III; John Martin, both of Racine, Wis.

[73] Assignee: S. C. Johnson & Son, Inc., Racine, Wis.

[21] Appl. No.: 137,296

[22] Filed: Dec. 23, 1987

[51] Int. Cl.[4] ..... A61L 9/03

[52] U.S. Cl. ..... 219/271; 219/275; 239/34

[58] Field of Search ..... 219/271, 272, 273, 274, 219/275, 276; 239/34, 53, 54, 55, 56; 206/439; 220/20, 22, 900; 428/35, 76, 905

[56] References Cited

U.S. PATENT DOCUMENTS

| | | | |
|---|---|---|---|
| Re. 29,705 | 7/1978 | Compere | 206/531 |
| D. 135,588 | 4/1943 | Naranick | D9/424 |
| 136,813 | 3/1973 | Clark | 220/20 |
| D. 218,089 | 7/1970 | Chadbourne | D9/424 |
| 290,141 | 12/1983 | Swift | 239/55 |
| 490,091 | 1/1893 | Whipple | 220/22 |
| 1,805,045 | 5/1931 | Lower | 206/564 |
| 2,422,814 | 6/1947 | Alexander | 91/54.5 |
| 2,736,656 | 2/1956 | Marshall | 99/171 |
| 2,858,224 | 10/1958 | Darrah | 426/119 |
| 2,918,379 | 12/1959 | Lurie | 99/174 |
| 2,931,880 | 4/1960 | Yaffe | 219/271 |
| 3,054,679 | 9/1962 | Bradford | 206/602 |
| 3,083,821 | 4/1963 | Woodson | 206/568 |
| 3,151,799 | 10/1964 | Engles, Jr. et al. | 229/2.5 R |
| 3,221,971 | 12/1965 | Reny | 229/2.5 |
| 3,325,000 | 6/1967 | Edwards | 206/56 |
| 3,420,431 | 1/1969 | Donovan | 229/2.5 |
| 3,464,832 | 9/1969 | Mullinix | 206/557 |
| 3,466,424 | 9/1969 | Adams | 219/275 |
| 3,561,668 | 2/1971 | Bergstrom | 229/43 |
| 3,595,422 | 7/1971 | Durrett | 220/20 |
| 3,866,820 | 2/1975 | Zemsteg | 229/43 |
| 3,885,737 | 5/1975 | Watkins | 239/34 |
| 3,912,081 | 10/1975 | Haines et al. | 206/601 |
| 3,923,458 | 12/1975 | Moran | 219/271 |
| 3,924,746 | 12/1975 | Haines | 206/530 |
| 3,990,848 | 11/1976 | Corris | 422/49 |
| 4,055,672 | 10/1977 | Hirsch et al. | 426/127 |
| 4,145,001 | 3/1979 | Weyenberg et al. | 239/56 |
| 4,157,787 | 6/1979 | Schwartz | 239/56 |
| 4,214,146 | 7/1980 | Schimanski | 219/274 |
| 4,356,969 | 11/1982 | Obermayer et al. | 239/6 |
| 4,383,377 | 5/1983 | Crafton | 34/60 |
| 4,391,781 | 7/1983 | Van Lit | 422/125 |
| 4,444,310 | 4/1984 | Odell | 206/366 |
| 4,544,592 | 10/1985 | Spector | 428/68 |
| 4,571,485 | 3/1986 | Spector | 219/276 |
| 4,583,686 | 4/1986 | Martens et al. | 239/35 |
| 4,588,874 | 5/1986 | Napierski | 219/271 |
| 4,629,604 | 12/1986 | Spector | 422/124 |
| 4,634,614 | 1/1987 | Holzner | 428/35 |
| 4,653,644 | 3/1987 | Sullivan et al. | 239/60 |
| 4,687,904 | 8/1987 | Melanson et al. | 219/271 |
| 4,703,155 | 10/1987 | Suhajda | 219/518 |
| 4,724,982 | 2/1988 | Redmond | 222/94 |

*Primary Examiner*—Teresa J. Walberg

[57] ABSTRACT

An open-ended tamper-resistant container has a flexible seal over the oven end. The tamper-resistant container is particularly suited for holding a volatile material for slow diffusion. The container has at least one free-standing rib which prevents downward pressure or squeezing on the flexible seal of the container which could otherwise rupture the seal and/or result in leakage of the material held in the container. The tamper-resistant container is suitable for independent use or use in conjunction with an electrically heated vapor dispensing apparatus.

17 Claims, 2 Drawing Sheets

TAMPER-RESISTANT CONTAINER UTILIZING A FLEXIBLE SEAL

FIELD OF INVENTION

The present invention is directed to be a tamper-resistant container utilizing a flexible seal particularly suited for holding a volatile material to be dispensed by slow diffusion. More particularly, the tamper-resistant container utilizes one or more free-standing ribs to prevent the container's flexible seal from being ruptured. The tamper-resistant container is suitable for independent use or for use with an electrically heated vapor dispensing apparatus.

BACKGROUND OF INVENTION

The prior art discloses open-ended containers for holding a volatile material which utilizes a plurality of layers to seal the container. Generally, one layer of material is permeable and permanently secured to the open end of the container and a second layer of material is impermeable and removable for when the container is utilized to dispense the volatile material. Thus, U.S. Pat. No. 4,157,787 discloses an air freshener dispenser having a container with an opening at its upper end surrounded by a peripheral flange. The open upper end of the container is covered with a porous layer secured to the upper surface of the flange and a removable nonporous layer which is removably secured to the upper surface of the porous layer. U.S. Pat. No. 4,145,001 discloses a package utilizing a multi-layer sealing laminate. The inner layer is permeable to a volatile material held within the package and the outer layer is impermeable. The outer layer is removed to expose the inner layer when the package is to be used.

The prior art also discloses containers useful for various purposes which have one or more upwardly directed projections in the base of the container. The projections, however, are not used in conjunction with a container seal. Thus, U.S. Pat. No. Des. 135,588 discloses a ration container comprising a tray with upstanding sidewalls having a ridge extending upward from the bottom surface of the tray to a level just below the upper edge of the tray sidewalls. U.S. Pat. No. 2,422,814 discloses a stamp pad having a bottom container divided into a plurality of ink containing reservoirs. The reservoirs are separated by upstanding ridges. An absorbent pad exends across the top of the reservoirs. When ink is to be absorbed into the pad from the reservoirs, the pad is pressed downward until it contacts the reservoirs between the ridges. U.S. Pat. No. 3,221,971 discloses a packaging tray having a plurality of upwardly curving figures around the edge of the tray and a rib means provided on the bottom of the tray. The rib means is disclosed as facilitating the placement of articles in the tray and ensuring that the articles remain properly positioned during transportation. While the packaging tray is disclosed for use with an overwrap, the rib does not extend upward above the articles held in the tray. U.S. Pat. No. 3,466,424 discloses a metallic cartridge for holding an evaporatable material. The cartridge has an opening in the central upper region of the cartridge. The cartridge additionally has a slightly raised portion in the bottom surface of the cartridge which reduces the amount of evaporatable material which can be disposed directly underneath the vapor exit port, provides for a hotter region in the area of the exit port, and prevents clogging of the openings in the exit port during vapor deposition.

Various containers are also disclosed in the prior art which utilize ribs and a container seal. However, the ribs and seal are not disclosed as operating in conjunction with each other. The ribs are solely related to the bottom structure of the containers and are utilized to provide strength, drainage or the like. For example, U.S. Pat. No. 4,055,672 discloses a package providing for a controlled atmospheric condition through the use of permeable and impermeable films and a package bottom wall containing downwardly extending grooves. The grooves provide a collection point for any fluid discharged from the material held within the package and also serve to enhance air circulation within the package once the outer impermeable layer is peeled away from the inner permeable layer.

The prior art also discloses various structures for electrically heated vapor dispensing apparatus which utilize containers or cartridges which are inserted into the apparatus and which hold a volatile material to be dispensed. Thus, U.S. Pat. No. 4,571,485 discloses an electrically heated aromatic generator utilizing a replaceable aroma cube which is insertable into a well in the generator. The cube is an open-ended chimney structure having a shallow box supported therein at its lower end by means of spider ribs which extend between the cube walls. A porous pad having good wicking properties is held within the box and is impregnated with a volatile aromatic liquid. The pad is covered with a wire or plastic net which is secured to the box to retain the pad therein. A peel-off cover can be placed over the net to prevent volatilization of the liquid during prolonged storage of the cube. U.S. Pat. No. 4,383,377 discloses a hot air hand dryer having a housing which includes a perforated container or cup for holding a vaporizable deodorizing material. The container or cup is screwed or snapped in place to the air dryer. The deodorizing material is in the form of a stick or cake which is placed in the container or cup through a slot in the container. U.S. Pat. No. 3,990,848 discloses a battery operated vapor dispensing device utilizing a cartridge for holding a vaporizable material. The cartridge includes a container having a number of holes in its top, bottom, and sides to facilitate the flow of air around a solid cylindrical block of vaporizable material which is held within the container. U.S. Pat. No. 4,629,604 discloses an aroma cartridge player wherein each cartridge holds a plurality of fragrances. The cartridge has a rectangular multi-sectioned framework. The cartridge is inserted into the cartridge player which utilizes heat to vaporize the volatile aromatic materials.

The prior art does not disclose the use of one or more free-standing ribs in conjunction with a flexible container seal to provide a tamper-resistant container. Further, the art does not disclose the use of such a container in combination with an electrically heated vapor dispensing apparatus.

OBJECTS OF THE INVENTION

A primary object of the present invention is to provide a container having a flexible seal and one or more free-standing ribs which is tamper-resistant.

A further primary object of the present invention is to provide a tamper-resistant container having a flexible seal and one or more free-standing ribs which is suitable for holding and dispensing a volatile material.

A further primary object of the present invention is to provide a tamper-resistant container for holding a volatile material having a flexible seal and one or more free-standing ribs which is suitable for use with an electrically heated vapor dispensing apparatus.

BRIEF SUMMARY OF INVENTION

The tamper-resistant container of the present invention is preferably a thermoformed plastic container. More particularly, the plastic container is a tray-like structure having an open upper end surrounded by a peripheral flange. The container can be filled with any desired material, but is particularly suited for holding and dispensing a volatile material. After the container is filled with a material, the open end of the container is sealed with a flexible seal. When the container is used to hold and dispense a volatile material, the seal preferably is multi-layered. The multi-layered seal has an inner non-removable layer of vapor permeable material and an outer removable layer of vapor impermeable material. When the volatile material is to be dispensed from the container, the outer vapor impermeable layer is peeled back from the container leaving the inner vapor permeable layer. The inner layer maintains the volatile material inside the container and prevents the user of the container from contacting the material while simultaneously allowing the vapor from the material to be released into the surrounding atmosphere.

The tamper-resistant feature of the package is in the form of a free-standing rib, or in the alternative a plurality of ribs, which are positioned within the container's walls, and which are integral with and extend upward from the container's bottom surface. Whether a single rib or a plurality of ribs are utilized, the rib or ribs do not extend from wall-to-wall in the interior of the container so that the rib or ribs do not divide the container into compartments. The rib(s) extend upward from the container's bottom surface to a level approximately coextensive with the peripheral flange surrounding the upper end of the container. The height of the rib(s) is such that it does not interfere with the attachment or placement of the container's seal. The rib(s) may also be at the same height as the flange and, less preferably, the bottom of the sealing layer may be adhered to the top of the rib to provide further strength to that layer. The free-standing rib(s) provides tamper-resistance in that the rib(s) prevents downward pressure or squeezing on the container seal which could othewise result in the rupture of the seal and leakage of the material held in the container. The rib(s) additionally increase the container's strength. Since the rib(s) are free-standing, i.e. do not extend from one wall of the container to another, the filling of the container remains efficient in that separate compartments are not separately filled.

The tamper-resistant container of the invention can be used independently for dispensing a particular material or it can be utilized in conjunction with an electrically heated vapor dispensing apparatus. When the tamper-resistant container of the invention is utilized with an electrically heated vapor dispensing apparatus, the rib(s) additionally serve to direct the heat generated by the apparatus. The rib(s) can also be provided with a keyway at one end of the container so that when the container is utilized with an electrically heated apparatus, the keyway, in conjunction with a projection in the apparatus, acts as a guide during insertion of the container into the apparatus and prevents the insertion of the container into the apparatus in the wrong direction.

FIGURES

PRESENTLY PREFERRED EMBODIMENT OF INVENTION

Figure 1:
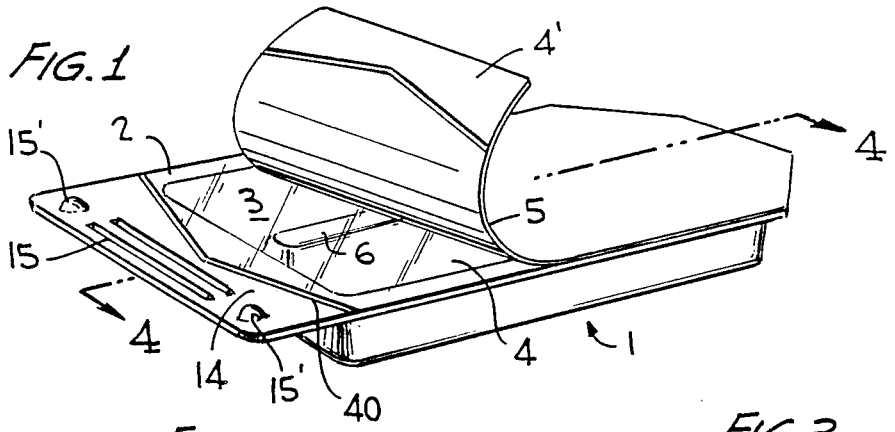
FIG. 1 is a perspective view of the tamper-resistant container of this invention with the impermeable layer of the seal partly removed.

The feature of the present invention which provides tamper-resistant properties to an open ended container can be utilized with any container of a similar structure having a flexible closure seal without regard to the material held in the container or the method of dispensing the material. The tamper-resistant container of the present invention is particularly suitable, however, for use in holding a volatile material which is to be slowly diffused into the surrounding atmosphere. Accordingly, for simplification of discussion and without limiting the scope of the invention, the invention will be described in relation to a container useful for slow diffusion of a volatile material.

The tamper-resistant container 1 of the present invention has an open upper end surrounded by a peripheral flange 2. The interior 3 of the container 1 can be filled with any suitable air treating volatile material, such as an air deodorizer, insecticide, or the like. After the container is filled with a volatile material, the upper open end is sealed with at least one flexible layer of material. Any conventional seal known in the art can be utilized. However, the flexible seal is preferably a plural layered seal comprising an inner non-removable layer of vapor permeable material 4 and an outer removable layer of vapor impermeable material 5. When the container is to be used and the volatile material diffused into the surrounding atmosphere, the outer vapor impermeable layer 5 is peeled away from the container's peripheral flange 2 and removed. The non-removable inner layer 4 maintains the volatile material in the container 1 and prevents the user from contacting the material while simultaneously allowing the vapor from the material to be released into the surrounding atmosphere.

The flexible seal, whether being a single layer or plural layers, can be attached to the peripheral flange 2 of the container 1 utilizing any conventional means, such as an adhesive, heat seal, crimping or the like.

Figure 11:
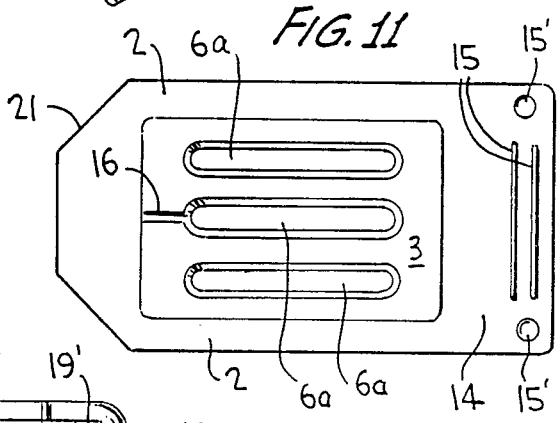
FIG. 11 is a bottom view, similar to the view of FIG. 2, illustrating a plurality of free-standing ribs within the tamper-resistant container.

Since the impermeable layer of the container seal is meant to be easily removed by a consumer when the container is to be used, the seal is subject to being broken or tampered with by downward pressure on the seal or by the squeezing of the container and seal. In order to prevent the breaking of the container seal in this manner, a free-standing rib 6, or in the alternative a plurality of ribs 6a as shown in FIG. 11, is or are formed as an integral part of the container. The rib or ribs may have any desired configuration consistent with the purpose described for them herein and could take the form of a raised logo or other design. In any case, the size of the rib should not take up a significant portion of the internal volume of the interior 3 since that reduces the amount of material which can be placed therein.

Figure 2:
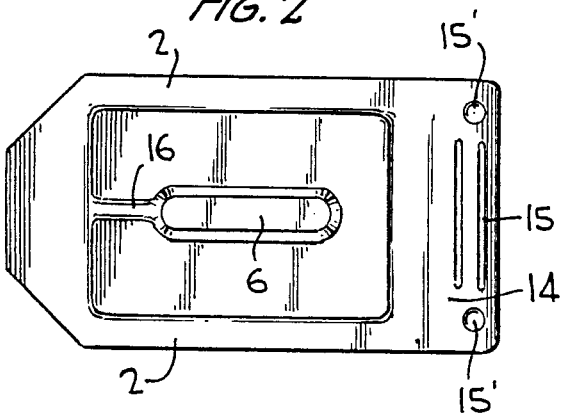
FIG. 2 is a bottom view of the tamper-resistant container.
Figure 3:
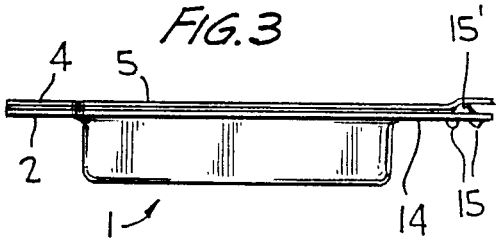
FIG. 3 is a side view of the tamper-resistant container.
Figure 4:
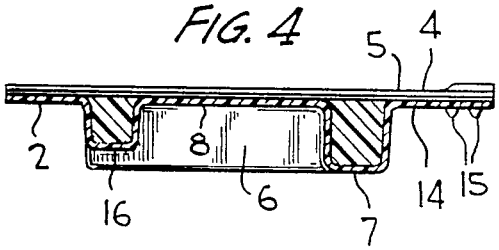
FIG. 4 is a sectional view taken along line 4—4 of FIG. 1.

The rib 6 or ribs 6a are free-standing within the walls or interior 3 of the container and are, preferably, an integral part of the container outer wall, as best shown in FIGS. 2 and 4. The free-standing rib 6 extends upward from the container's bottom surface 7 to a level approximately coextensive with the level of the peripheral flange 2 of the container. The top surface 8 of the rib 6 is located slightly below the bottom surface of the inner permeable sealing layer 4 so as not to interfere with the attachment or placement of the sealing layer(s) on the container 1. While the rib 6 is substantially equal in height to the height of the container's sidewalls, the length of the rib 6 is preferably not equal to the length of the container's interior, i.e. the ribs 6 are wholely contained within the walls of container 1 without joining with the walls to form compartments within the container. The shortened length of the rib increases the container strength since it does not provide a crease line. Further, the shortened length of the rib allows a one shot filling of the interior of the container rather than requiring multiple separate fillings of separate compartments which would be required if the rib extended the entire length of the container. When downward pressure is placed on the sealing layer(s) of the container or the sealing layer(s) are squeezed, the rib is contacted thereby preventing the downward movement of the sealing layer(s) and any rupture of the sealing layer(s) and leakage of volatile material from the container is prevented.

The ratio of the height of the rib from the bottom surface of the container relative to the distance between the flange and bottom surface should be such that the sealing layer rests upon the top of the rib or ribs in response to pressure upon the sealing layer. This permits the rib or ribs to support the sealing layer(s) as described above. The above ratio is also dependent upon the degree to which interior 3 of the container is filled since filling interior 3 to a degree which does not permit the sealing layer(s) to contact the rib after sealing will negate its purpose. Substantial overfilling should be avoided because it can allow pressure to be placed upon the sealing layer without contact with the rib and thus raises the possibility that the sealing layer(s) can rupture during handling.

When a plurality of ribs are utilized, the ribs can extend either lengthwise, as shown in FIG. 11, or across the width of the container. Preferably, however, as with a single rib, the ribs do not extend from wall to wall in the interior of the container and thus do not form compartments in the container. The same advantages as described above with respect to a single rib also apply with respect to utilizing a plurality of ribs.

The materials utilized for making the container and sealing layer(s) are dependent on the material being held in and dispensed from the container. The container is preferably formed utilizing a thermoformed plastic. This provides for the easy molding and incorporation of the rib or ribs into the container structure. A closure sealing utilizing both a permeable and impermeable sealing layer as well as the material for the container itself can be of the type disclosed in U.S. Pat. No. 4,145,001 which is incorporated herein by reference.

A specific example of a volatile material suitable for dispensing from the tamper-resistant container of the present invention is a terpene-based fragrance. A suitable seal for the container for use with the fragrance utilizes a low density polyethylene as the permeable non-removable inner permeable layer and a coated aluminum foil as the impermeable outer removable layer. A semipermeable layer as well as a microporous layer can be employed as the permeable layer. A wide variety of acceptable combinations depending on the volatile material used are known to those skilled in the art as can be seen from, for example, an examination of U.S. Pat. No. 4,055,672 to Hirsch et al. and U.S. Pat. No. 4,145,001 to Weyenberg et al.

The tamper-resistant container of the present invention can be utilized independently in any conventional manner of utilizing an open ended container having a flexible seal. As stated above, a preferred use is as a slow diffusion air treating material containing package which is placed in an appropriate location after removal of the impermeable sealing layer to allow the slow diffusion of the volatile material into the surrounding atmosphere.

Figure 8:
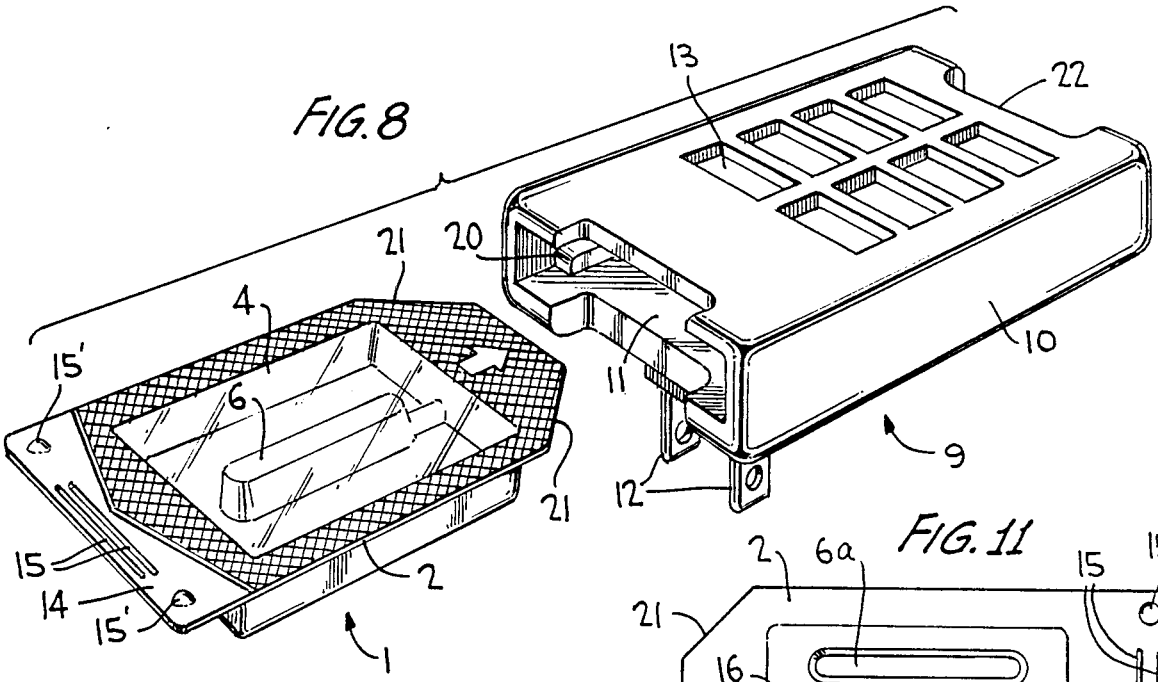
FIG. 8 illustrates the tamper-resistant container with the top impermeable layer removed being inserted into an electrically heated vapor dispensing apparatus.
Figure 9:
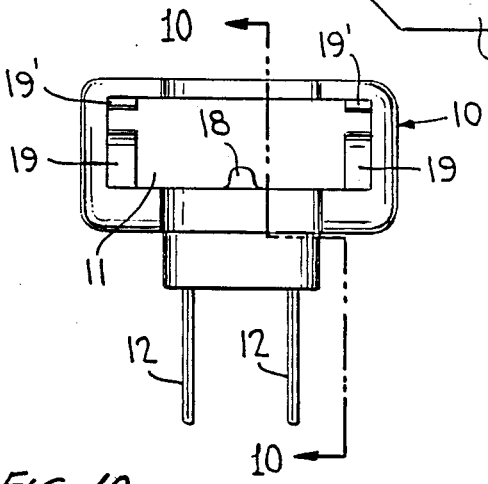
FIG. 9 is an end view of an embodiment of the electrically heated vapor dispensing apparatus of FIG. 8 through the end into which the tamper-resistant container is to be inserted.
Figure 10:
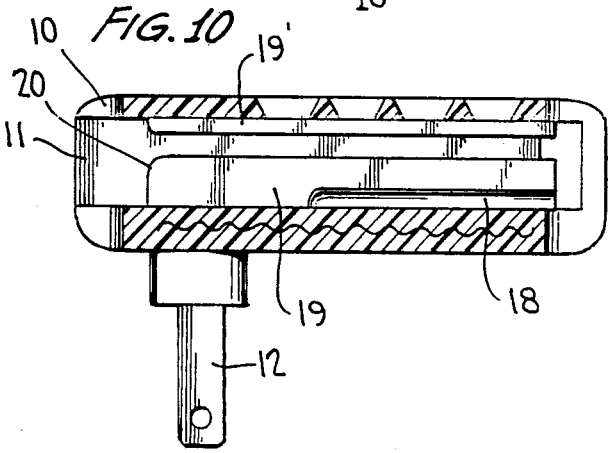
FIG. 10 is a sectional view taken along line 10—10 of FIG. 9 of the electrically heated vapor dispensing apparatus.

Additionally, the tamper-resistant package of the present invention is particularly suitable for use as a single use cartridge for an electrically heated vapor dispensing apparatus. When utilized with as electrically heated vapor dispensing apparatus, the tamper-resistant container is made in the shape of a cartridge which complements the interior structure of the electrically heated apparatus. One example of such an electrically heated apparatus is shown in FIGS. 8–10. The apparatus 9 comprises a body 10 having a slot 11 extending through the body in which the tamper-resistant container 1 is insertable. The body 10 of apparatus 9 is preferably thermoformed and has an integral part thereof a heating element (not shown) and an electrical plug 12 which is to be inserted into an electric outlet during use of the apparatus.

When the heating apparatus is to be utilized to generate a vapor, the impermeable seal of the volatile material holding container is removed and the container 1 inserted into slot 11 of apparatus 9. Ridges 19 are formed as an integral part of body 10. The peripheral flange 2 of container 1 slides along the top of ridges 19 and are supported thereby when the container 1 is in place. The ends 20 of ridges 19 are preferably rounded to aid insertion of container 1. Upper ridges 19' are also provided to guide the flange 2 and container 1 into apparatus 9. After the container is inserted into apparatus 9, the electrical plug 12 of heating apparatus 9 is inserted into an electric outlet. The interior of the apparatus is heated thereby causing the material contained in the tamper-resistant container to be heated and diffused into the surrounding atmosphere through the permeable inner sealing layer 4 of the container 1 and the openings 13 in the outer wall of body 10 of the electrically heated apparatus.

Various modifications can be made to the tamper-resistant container. For example, when the container is utilized either independently or with an electrically heated vapor dispensing apparatus, one end of the peripheral flange surrounding the open end of the container can be extended in length. The extended portion 14 provides a gripping or holding area for the user. This further aids in preventing the rupture of the container's flexible seal by providing an alternate place for holding the container. When utilized with an electrically heated apparatus, the extended portion 14 provides an area to hold during the insertion of the container 1 into the heating apparatus 9. The extended portion 14 can additionally have a projection or projections 15 protruding from at least one surface of the extended portion 14 in any form, such as lines, bulbs, the name or logo of the seller in raised outline, or the like, which provide for better gripping of the extended portion of the flange. The projection or projections are preferably on the underside of the extended portion if a fingerhold area is desired. Projections 15' on the extended portion 14 are present if no other projections are present on the upper surface of the extended portion 14. The projections 15' serve to separate the laminate of layers 4 and 5 from extended portion 14 so that the user can more easily grasp the end of the laminate and remove impermeable layer 5 prior to use.

Figure 5:
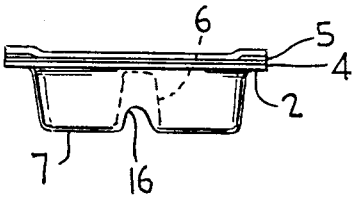
FIG. 5 is an end view of an embodiment of the tamper-resistant container having a keyway.
Figure 6:
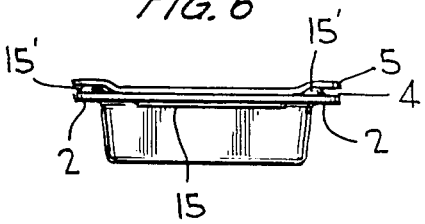
FIG. 6 is an end view of an embodiment of the tamper-resistant container without a keyway.
Figure 7:
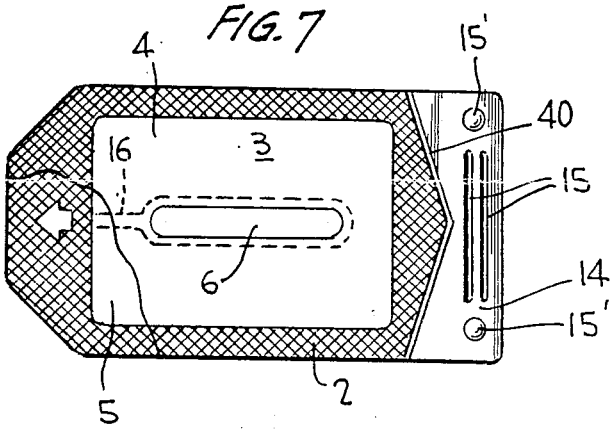
FIG. 7 is a top view of the tamper-resistant container with the impermeable sealing layer partially cut-away but with the permeable sealing layer intact.

When the tamper-resistant container is utilized as a container or cartridge for insertion into an electrically heated vapor dispensing apparatus, the cartridge can have as an integral part of the container walls a keyway 16 which is utilized in connection with a projection 18 in the form of an upraised knob or bar in the interior of the electrically heated apparatus 9. The keyway 16 is formed in the bottom surface wall 7 of the container 1 in the end of the container which is to be inserted first into the electrically heated apparatus. The keyway 16 comprises a raised area in the container end wall, such as shown in FIGS. 2, 4, and 5, which allows the cartridge to ride over the projection 18 contained on the inner bottom surface of the electrically heated apparatus 9. If a bar 18, such as shown in FIG. 10, is utilized rather than a knob, the bar only extends partway into the interior of the apparatus since the keyway 16 and rib 6 of the container do not extend the total length of the container. Once the bar 18 meets the bottom wall of the container, the forward motion of the container will be stopped. Whenever the cartridge is inserted keyway-containing end first, the projection acts as a guide for the cartridge. However, when the cartridge is inserted non-keyway containing end first, the projection will strike the solid end wall of the container and block the insertion of the container into the apparatus. The use of the keyway and projection therefore ensures that the cartridge is inserted into the apparatus in the proper position enabling placement of the cartridge in the most advantageous position in relation to the heating element in the apparatus 9. Additionally, proper placement ensures easy removal of the cartridge from apparatus 9.

To further aid the proper insertion of the tamper-resistant container as a cartridge into an electrically heated apparatus, an arrow can be formed or imprinted in one end of the container's flexible seal, as illustrated for example in FIG. 8, to show the proper direction of insertion.

Additionally to aid in removal of the container from a heated apparatus, the container's shape can be formed to complement the apparatus structure. For example, the container can have its end corners cut at an appropriate angle 21 or other shape to complement the electrically heated apparatus structure. When the container 1 has an angled end 21, such as shown in FIG. 8, the forward end of the container will project slightly from the opposite end 22 of the electrically heated apparatus 9 thereby providing a portion of the container which can be used by the consumer to push the container 1 outward from the electrically heated apparatus 9 when the container is to be removed from the apparatus 9. When the container is pushed outward, the extended portion 14 is easily gripped by the user and the container pulled out of the apparatus 9 without having to contact the portion of the container which held the volatile material.

A tamper-resistant container of the type illustrated in FIG. 1 was constructed for use in an electrically heated apparatus of the type illustrated in FIGS. 8–10. A multilayer laminate of the type described in U.S. Pat. No. 4,145,001 was employed as the sealing layer using aluminum foil as the impermeable layer adhesively laminated to a coextrusion of a transparent low density polyethylene permeable layer and a polypropylene release layer, the latter to permit removal of the impermeable layer/release layer from the polyethylene permeable layer. The container was a thermoformed laminate of a thermoplastic acrylonitrile copolymer impermeable outer layer and an ethylene/vinyl acetate copolymer inner layer separated by a nylon tie layer to permit the polyethylene layer to be heat-sealed to the ethylene/vinyl acetate copolymer. The sealing layer is heat-sealed to the container using a hot die so that a chevron-shaped front edge 40 is formed along which the remainder of the laminate, including the impermeable layer 5 and a small portion of the premeable layer designated 4' in the drawings, is separated from the premeable layer 4 which retains the volatile material within the container.

The interior 3 of the thermoformed container was nominally 1.5 inches long by 1.06 inches wide and the overall height of the container from the bottom surface 7 of the container to the top surface of the flange was nominally 0.300 inches. The flat surface of rib 6 was 0.75 inches in its longest dimension and tapered outward toward the container bottom at a 15° angle. The top surface of rib 6 was nominally 0.020 inches below the upper surface of the flange of the container. At its apex, keyway 16 was 0.090 inches from the bottom surface 7 of the container. The interior volume of the container was about 6 cubic centimeters and the container was filled with about 5 grams (out of about a 6 gram fill capacity) with a thixotropic gelled terpene based fragrance. The sealing layer rested upon the top of the rib 6 in response to finger pressure on the center of the cartridge. In this case, the ratio of the height of the rib to the distance between the flange and the bottom of the container was $(0.3-0.02)/0.3$ or 0.933:1.

As will be apparent to one skilled in the art, various modifications can be made within the scope of the aforesaid description. Such modifications being within the ability of one skilled in the art form part of the present invention and are embraced by the appended claims.

It is claimed:

1. A tamper-resistant volatile material dispenser comprising an open-end container having a peripheral flange surrounding an open end having a bottom surface and side walls, with at least one flexible sealing layer attached to a top surface of said peripheral flange to form an interior region wherein at least one sealing layer is permeable to a volatile material enclosed within said interior region, and having at least one free-standing rib extending upward from the bottom surface of said container within said interior region to a level approximately coextensive with said peripheral flange, said container being impermeable to said volatile material and further having a keyway formed in one end only of said container.

2. A dispenser as claimed in claim 1 having a keyway formed in said bottom surface and being in contact with said rib.

3. A tamper-resistant volatile material dispenser comprising an open-ended container having a peripheral flange surrounding an open end having a bottom surface and side walls, with at least one flexible sealing layer attached to a top surface of said peripheral flange to form an interior region wherein at least one sealing layer is permeable to a volatile material enclosed within said interior region, and having a least one integral free-standing rib extending upward from the bottom surface of said container within said interior region to a level approximately coextensive with said peripheral flange, but not attached to said flexible sealing layer said container being impermeable to said volatile material.

4. A dispenser according to claim 3 wherein said container has only one free-standing rib and said free-standing rib is contained within the walls of said container but not joined with said walls so as not to form separate compartments within said container.

5. A dispenser according to claim 3 wherein said container has a plurality of said free-standing ribs and said free-standing ribs are contained within the walls of said container but not joined with said walls so as not to form separate compartments within said container.

6. A dispenser according to claim 3 wherein said peripheral flange at one end of said container is extended in length.

7. A dispenser according to claim 3 wherein said sealing layer is multi-layered and further contains a removable layer which is impermeable to said volatile material.

8. A dispenser according to claim 3 wherein the ratio of the height of the rib to the distance between the upper surface of the flange and the bottom surface of the container opposite the open end is such that said sealing layer rests upon said rib in response to pressure upon the sealing layer, the amount of volatile material present therein being such to permit such contact with said rib.

9. In combination, a tamper-resistant volatile material dispenser comprising an open-ended container having a peripheral flange surrounding an open end having a bottom surface and side walls, with at least one flexible sealing layer attached to a top surface of said peripheral flange to form an interior region wherein at least one sealing layer is permeable to a volatile material enclosed within said interior region, and having at least one integral free-standing rib extending upward from the bottom surface of said container within said interior region to a level approximately coextensive with said peripheral flange, but not attached to said flexible sealing layer, said container being impermeable to said volatile material; and an electrically heated vapor dispensing apparatus constructed and arranged to receive said open-ended container and whereby said apparatus heats said volatile material contained in said container causing said volatile material to diffuse into the surrounding atmosphere.

10. A combination according to claim 9 wherein said container has only one free-standing rib and said free-standing rib is contained within the walls of said container but not joined with said walls so as not to form separate compartments within said container.

11. A combination according to claim 9 wherein said container has a plurality of said free-standing ribs and said free-standing ribs are contained within the walls of said container but not joined with said walls so as not to form separate compartments within said container.

12. A combination according to claim 9 wherein said peripheral flange at one end of said container is extended in length.

13. A combination according to claim 9 wherein said sealing layer is multi-layered and further contains a removable layer which is impermeable to said volatile material.

14. A combination according to claim 9 wherein the ratio of the height of the rib to the distance between the upper surface of the flange and the bottom surface of the container opposite the open end is such that said sealing layer rests upon said rib in response to pressure upon the sealing layer, the amount of volatile material present therein being such to permit such contact with said rib.

15. In combination, a tamper-resistant volatile material dispenser comprising an open-ended container having a peripheral flange surrounding an open end having a bottom surface and side walls, with at least one flexible sealing layer attached to a top surface of said peripheral flange to form an interior region wherein at least one sealing layer is permeable to a volatile material enclosed within said interior region, and having at least one free-standing rib extending upward from the bottom surface of said container within said interior region to a level approximately coextensive with said peripheral flange, said container being impermeable to said volatile material; and an electrically heated vapor dispensing apparatus constructed and arranged to receive said open-ended container and whereby said apparatus heats said volatile material contained in said container causing said volatile material to diffuse into the surrounding atmosphere, wherein said container has a keyway formed in one end only of said container and said electrically heated vapor dispensing apparatus has a projection extending upward from the inner bottom surface of said apparatus which in conjunction with said keyway blocks said container from being inserted into said apparatus when said container is not inserted keyway containing end first.

16. A tamper-resistant volatile material dispenser comprising an open-ended container having a peripheral flange surrounding an open end having a bottom surface and side walls, with at least one flexible sealing layer attached to a top surface of said peripheral flange to form an interior region wherein at least one sealing layer is permeable to a volatile material enclosed within said interior region, and having at least one free-standing rib extending upward from the bottom surface of said container within said interior region to a level approximately coextensive with said peripheral flange, said container being impermeable to said volatile material, wherein said peripheral flange at one end of said container is extended in length and has at least one projection protruding from at least one surface of the extended flange.

17. In combination, a tamper-resistant volatile material dispenser comprising an open-ended container having a peripheral flange surrounding an open end having a bottom surface and side walls, with at least one flexible sealing layer attached to a top surface of said peripheral flange to form an interior region wherein at least one sealing layer is permeable to a volatile material enclosed within said interior region, and having at least one free-standing rib extending upward from the bottom surface of said container within said interior region to a level approximately coextensive with said peripheral flange, said container being impermeable to said volatile material; and an electrically heated vapor dispensing apparatus constructed and arranged to receive said open-ended container and whereby said apparatus heats said volatile material contained in said container causing said volatile material to diffuse into the surrounding atmosphere, wherein said peripheral flange is extended in length and has at least one projection protruding from at least one surface of the extended flange.

* * * * *